United States Patent [19]

Hiratsuka et al.

[11] Patent Number: 4,492,638

[45] Date of Patent: Jan. 8, 1985

[54] METHOD FOR AGGLOMERATING COAL PARTICLES IN PULP WATER

[75] Inventors: Kosai Hiratsuka; Yoichi Nakamura; Morihisa Maruko, all of Kudamatsu; Yoshio Matsuura, Funabashi; Michio Kurihara, Chiba, all of Japan

[73] Assignees: Hitachi, Ltd.; Electric Power Development Co., Ltd., both of Tokyo, Japan

[21] Appl. No.: 506,871

[22] Filed: Jun. 22, 1983

Related U.S. Application Data

[63] Continuation of Ser. No. 317,984, Nov. 4, 1981, abandoned.

[30] Foreign Application Priority Data

Nov. 7, 1980 [JP] Japan ..... 55-155971

[51] Int. Cl.[3] ..... B01D 21/01

[52] U.S. Cl. ..... 210/728; 210/738; 210/201; 264/117; 23/313 R; 23/314

[58] Field of Search ..... 210/729, 738, 728, 727, 210/198.1, 201, 248, 511, 524, 525, 533; 425/222; 44/1 A; 23/313, 314; 209/171, 173, 49, 53; 264/117; 162/183

[56] References Cited

U.S. PATENT DOCUMENTS

| | | | |
|---|---|---|---|
| 1,420,165 | 6/1922 | Trent | 44/1 A |
| 3,268,071 | 8/1966 | Puddington et al. | 210/738 |
| 4,080,358 | 3/1978 | Tan et al. | 210/729 |
| 4,239,718 | 12/1980 | Dudt | 23/314 |
| 4,260,485 | 4/1981 | Corr et al. | 210/728 |
| 4,277,252 | 4/1981 | Dudt | 210/727 |
| 4,290,897 | 9/1981 | Swihart | 210/728 |

*Primary Examiner*—Richard V. Fisher
*Assistant Examiner*—Wanda L. Millard
*Attorney, Agent, or Firm*—Antonelli, Terry & Wands

[57] ABSTRACT

Coal particles are agglomerated in pulp water of coal particles by agitating the pulp water in the presence of a binder, which comprises conducting agglomeration in a plurality of zones, the zones being communicated one after another, and transferring the pulp water from one zone to another while agitating the pulp water in each zone and increasing a pulp concentration of the pulp water from one zone to another. Agitating power for the agglomeration is reduced with the successively increasing pulp concentration.

6 Claims, 5 Drawing Figures

METHOD FOR AGGLOMERATING COAL PARTICLES IN PULP WATER

This is a continuation of Ser. No. 317,984, filed Nov. 4, 1981, now abandoned.

BACKGROUND OF THE INVENTION

1. FIELD OF THE INVENTION

This invention relates to a method for agglomerating coal particles suspended in water.

2. PRIOR ART

Transporting coal in the form of pulp water of coal particles prepared by mixing coal particles with water has such an advantage, among others, that scattering of coal particles never occurs during the transportation.

In this case, however, the sum of inherent moisture contained in coal particle and adherent moisture attached to coal particles, that is, total moisture content, becomes so high that combustion efficiency becomes poor if coal particles taken from the pulp water are used directly by conventional practice.

Heretofore, it has been the ordinary expendent to agitate the pulp water in the presence of a binder, such as a unhydrophobic oil so that a higher affinity of the binder toward coal particles can be utilized and adherent moisture content of coal particles is replaced with the binder to effect dewatering, while the coal particles bind themselves together and agglomerate to larger sizes by the action of the binder and by agitation.

The agglomeration process proceeds, successively through three major steps, i.e. coagulation step where the coal particles join together merely by weak binding force to small masses, growth step where the small masses take the surrounding coal particles into themselves to form larger masses by a strong binding force, and concentration step where the larger masses turn or swirl in the agitating pulp water stream to take surrounding finer coal particles into themselves and to form compact or high density masses with smooth peripheral surfaces of good dewatering in shapes of small water-adhering area, that is, in the spherical or ellipsoidal shapes, by stronger binding force. The water within the masses is squeezed out therefrom by attainment of the high density state.

Such process has been used not only to improve the dewatering but also to remove ashes or recover fine coal particles from waste water.

One prior example of it is disclosed in Japanese Laid-open patent appllication No. 70076/78, where an oil fraction as the binder is made an aqueous emulsion before it is added to pulp water, and the resulting aqueous emulsion is added to the water pulp and agitated; the pulp water remaining after removal of the resulting coagulates is subjected to at least one more repetition of the addition of the aqueous emulsion and the successive agitating. It is stated therein that the consumption of both binder and energy can be reduced. However, the efficiency of agglomeratation is lowered with decreasing pulp concentration, and thus it is necessary to increase the pulp concentration. However, more increase in pulp concentration leads to more consumption of power for agitating the pulp water. This is a disadvantage of the prior art.

SUMMARY OF THE INVENTION

An object of the present invention is to provide a more efficient method for agglomeration of coal particles in pulp water containing the same with less consumption of agitating power in the agglomeration process.

The present invention provides a method for agglomerating coal particles in pulp water of coal particles by agitating the pulp water in the presence of a binder, which comprises conducting agglomeration in a plurality of zones, the zones being communicated one after another, and transferring the pulp water from one zone to another while agitating the pulp water in each zone and increasing the pulp concentration (i.e., the concentration of particles) in the pulp water from one zone to another.

PREFERRED EMBODIMENTS OF THE PRESENT INVENTION

Figure 1:
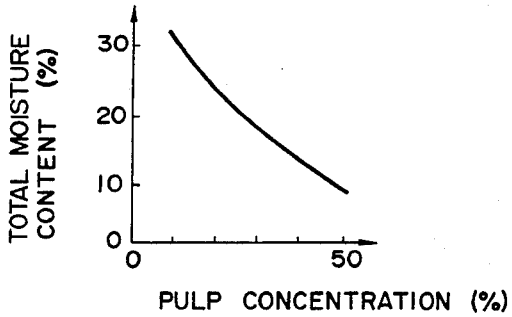
FIG. 1 is a diagram showing the relationship between the pulp concentration and total moisture content at agglomeration as the basis of the present invention.

The present inventors conducted agglomeration test by increasing a pulp concentration up to 50% by weight in terms of coal particles in pulp water to determine total moisture content of the coal particles, and found that the total moisture content was inversely proportional to the pulp concentration, as shown by FIG. 1. It was found that product agglomerates with better dewatering can be obtained by increasing the pulp concentration. Another agglomeration test was conducted for a predetermined time by changing the pulp concentration.

Figure 2:
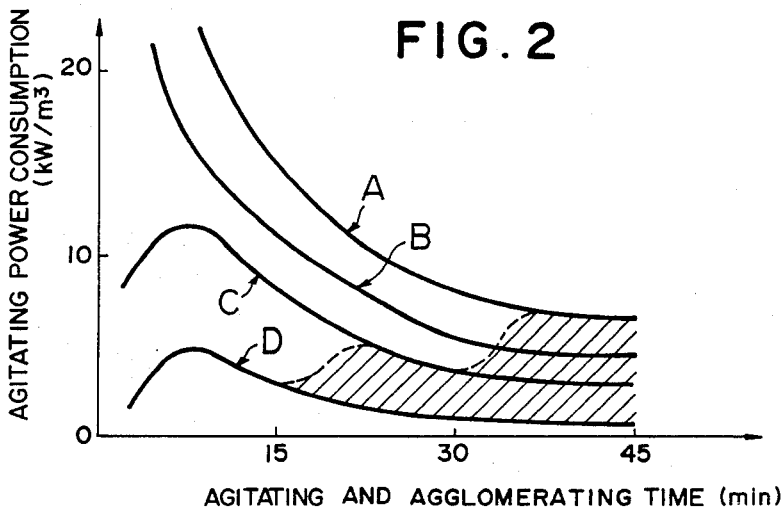
FIG. 2 is a diagram showing the relationship between agitating power consumption and agglomeration time with respect to pulp concentrations as a parameter as the basis of the present invention.

As shown in FIG. 2, it was found that the pulp concentration of 50% by weight in terms of coal particles has the relation shown by curve A, the pulp concentration of 45% by weight in terms of coal particles has the relation shown by curve B, the pulp concentration of 40% by weight in terms of coal particles has the relation shown by curve C, and the pulp concentration of 35% by weight in terms of coal particles has the relation shown by curve D. The curves A, B, C and D show that the viscosity is decreased with decreasing pulp concentration, and less agitating power consumption is required.

When the curves A, B, C and D are investigated. one by one, it is seen that power consumption decreases much sharply with time in the cases of curves A and B, but in the case of curve C the power consumption decreases rather gently with time, and in the case the curve D the power consumption decreases more gently with time. All the curves A, B, C and D tend to approach one another at the lower level of power consumption with time.

The above results indicate that pulp concentration must be increased for better dewatering of coal particles, whereas it must be decreased for less power consumption.

The agglomeration process is used for removing water and ashes from coal particles and in anyway a highly dewatered agglomerates must be obtained. Thus, it is ultimately necessary to increase the pulp concentration, but the power consumption increases, if the pulp concentration is increased from the beginning as shown by curve A. Thus, it was found that it is preferable to increase the pulp concentration after the peak time zone (less than 15 minutes) of the power consumption is over. The peak time zone corresponds to the first time zone, and thus to the coagulation step, which is the first stage of the agglomeration process. Thereafter, the growth step and then the concentration step follow the coagulation step.

It is appropriate that the time for starting to increase the pulp concentration be the time from the growth step where stronger binding is initiated. Even if the increase in the percentage by weight of coal particles is started from the coagulation step where no strong binding takes places, that is, in the earlier time zone, such dewatering as to agglomerate the increased amount of coal particles to a higher density as if the mass of the coal agglomerates were concentrated cannot be obtained, and the efficiency is deteriorated in proportion to the increased power consumption. The rapid increase in the pulp concentration in the growth step means a shift from curve C directly to curve A, which is not preferable because of a consequent increase in overall power consumption.

The present inventors have found the most efficient process for agglomeration is by gradually increasing the pulp concentration, that is, by increasing the pulp concentration to an intermediate level in the growth step, and then by increasing the pulp concentration to the final level in the concentration step.

Figure 3:
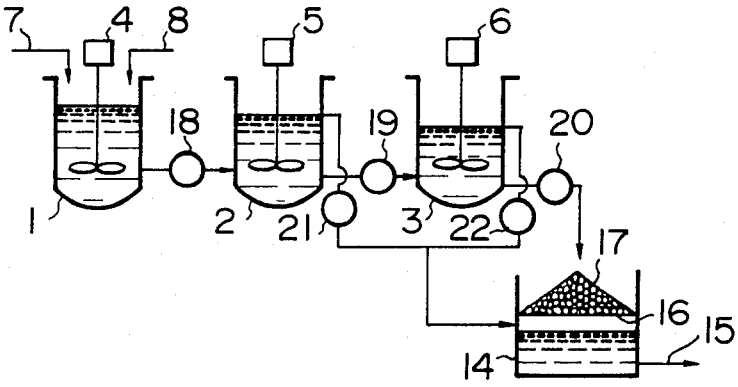
FIG. 3 is a schematic flow diagram according to one embodiment of the present invention.

Process and apparatus for performing the agglomeration process continuously on a commercial scale are shown schematically in FIG. 3.

Pumps 18 and 19 each with a flow rate control valve are inserted between first agitating vessel 1 and second agitating vessel 2 and between second agitating vessel 2 and third agitating vessel 3, respectively, so that pulp water may be transferred from one agitating vessel to another. Pump 21 with a flow rate control valve is provided between second agitating vessel 2 and agglomerate tank 14 so that supernatant may be withdrawn from second agitating vessel 2; likewise, pump 22 with a flow rate control valve is provided between third agitating vessel 3 and agglomerate tank 14 to withdraw supernatant from third agitating vessel 3. Pump 20 with a flow rate control valve is provided between third agitating vessel 3 and agglomerate tank 14 to withdraw agglomerates. First agitating vessel 1 is provided with an inlet for raw pulp water 7 of coal particles and an inlet 8 for binder. Arrow marks in FIG. 3 indicate the direction of flow as well as pipings. The pipings from pumps 21 and 22 are connected to a position below screen 16 in agglomerate tank 14, whereas the piping from pump 20 is connected to a position above screen 16 in the tank, so that agglomerates 17 may be received on screen 16. That is, no re-mixing of agglomerates with supernatant should take place. Drain piping 15 is connected to supernatant storage section below screen 16 in agglomerate tank 14 so as to prevent the supernatant from rising to the level of agglomerates.

First agitater 4 is provided in first agitating vessel 1, a second agitater 5 in second agitation vessel 2, and third agitater 5 in third agitating vessel so that the agitating blades of the respective agitaters may be positioned within the agitating vessels.

In the agglomeration in the apparatus of the embodiment, raw pulp water 7 with a pulp concentration of 35% by weight in terms of coal particles, which has been transported through a slurry line, etc. and binder 8 including oil having a strong affinity towards the coal particles are charged into first agitating vessel 1, and agitated and mixed by first agitater 4, whereby the coagulation step is initiated. The agitating time for the coagulation step is initial 15 minutes, and the power is consumed along curve D of FIG. 2.

Then, the water pulp is transferred together with the binder from first agitating vessel 1 to second agitating vessel 2 by pump 18. Then, fresh raw pulp water and fresh binder are charged into first agitating vessel 1 to conduct coagulation step again.

Supernatant of the pulp water transferred into second agitating vessel 2 after the coagulation step is transferred to agglomerate tank 14 by pump 21 and discharged therefrom. The pulp concentration of the pulp water in second agitating vessel 2 is increased to 40% by weight in terms of coal particles thereby. The pulp water with the increased pulp concentration was agitated by second agitater 5 in second agitating vessel to carry out growth step. The coagulation step simultaneously taking place in first agitating vessel 1 takes 15 minutes, and thus, the growth step should be synchronized by continuing the growth step for the same 15 minutes to eliminate any waiting time for the transfer from first agitating vessel 1 to second agitating vessel 2. Agitating power consumption makes its way along the dotted line from curve D to curve C and then along curve C in FIG. 2, since the pulp concentration is 40% by weight in terms of coal particles.

After the completion of growth step, the pulp water is transferred to third agitating vessel 3 from second agitating vessel 2 together with the binder by pump 19. Then, the transfer of the pulp water from first agitating vessel 1 to second agitating vessel 2 and then charging of fresh raw pulp water and fresh binder to first agitating vessel 1 are carried out successively. Supernatant water of the pulp water is transferred from third agitating vessel 3 to agglomerate tank 14 by pump 22, and discharged. The pulp concentration is increased to 50% by weight in terns of coal particles in third agitating vessel 3 thereby. After the pulp concentration has been increased to the final one as above, the pulp water in third agitating vessel 3 is agitated by third agitater 6 to conduct concentration step. The concentration step is continued for 15 minutes for synchronization with the other steps to eliminate the waiting time for the transfer between the agitating vessels. At that time, power consumption makes its way along the dotted line from curve C to curve A, and then along curve A. After the completion of concentration step, the pulp water is taken onto screen 16 in agglomerate tank 14 by pump 20. Agglomerates 17 are retained on screen 16, whereas water is drained downwards through screen 16 and discharged. The downward drainage of water can be smoothly carried out through and between larger agglomerates on the screen without any inhibition by fine coal particles, and can be accelerated by the unhydrophobic oil of the larger agglomerates coated with the unhydrophobic oil.

After the completion of the concentration step and transfer of the pulp water from third agitating vessel 3 to agglomerate tank 14, transfer to second agitating vessel to third agitating vessel, then transfer to first agitating vessel to second agitating vessel, and charging of fresh raw pulp water and fresh binder are carried out successively. The respective steps are carried out successively without waiting time for the transfer between vessels, and agglomerates of coal particles can be massproduced with very good efficiency.

In the mass production of the agglomerates, the respective pumps can be driven continuously under appropriate flow rate control to conduct the respective steps, while charging fresh raw pulp water of coal particles 7 and binder 8 into first agitating vessel 1 and withdrawing the agglomerates continuously.

In the foregoing embodiment, transfer of pulp water is carried out by pumps, but can be carried out by providing a trough between one agitating vessel and another and passing the pulp water through the trough by gravity from one agitating vessel to another.

The pulp concentration can be increased by inclining the above-mentioned trough, providing the trough with a screen having a mesh small enough not to pass the agglomerates therethrough at the side in contact with the pulp water, providing a water tank at the position below the screen to receive the falling water from the screen, discharging some portion of water from the water tank through a flow rate control valve introducing the remaining portion of water to the succeeding agitating vessel from the water tank, and introducing the drained agglomerates over the inclined trough into the same succeeding agitating vessel by gravity in place of discharging the supernatant from an agitating vessel by a pump.

Furthermore, the pulp concentration can be increased by adding fresh coal particles to the agitating vessels.

In the foregoing embodiment, power consumption makes its way along the initial curve D, then the dotted line from curve D to curve C, then along curve C, then the dotted line from curve C to curve A, and then along curve A with time, where agglomeration is carried out while increasing the pulp concentration without passing through the high level portions of curves A and C in FIG. 2. Thus, the power consumption for high density agglomeration is larger by the integrated power consumption in the hatched area over curve A in FIG. 2 than the one along curve D, but is much less than that along curve A showing the final pulp concentration from the start. Thus, the agglomeration process can be carried out efficiently with much less agitating power consumption in the present invention.

Since any desired power consumption curve can be selected by adjusting the pulp concentration, it is ready to select the most efficient power consumpiton curve.

The present inventors have found that a better result can be obtained by carrying out the coagulation step at a pulp concentration of 40% by weight or less in terms of coal particles, the concentration step at a pulp concentration of 45% by weight or more in terms of coal particles, and the growth step at a pulp concentration between 40 and 45% by weight in terms of coal particles. That is, when the agglomeration process is carried out with agitating, the pulp water tends to swirl together with the agitater at a higher pulp concentration and uniform mixing by agitating cannot be attained. That is, only a portion of the pulp water is agglomerated. Such phenomenon is liable to appear when there prevail small coal particles, that is, when overall surface area of coal particles is large and the overall force of coagulation is high.

Figure 4:
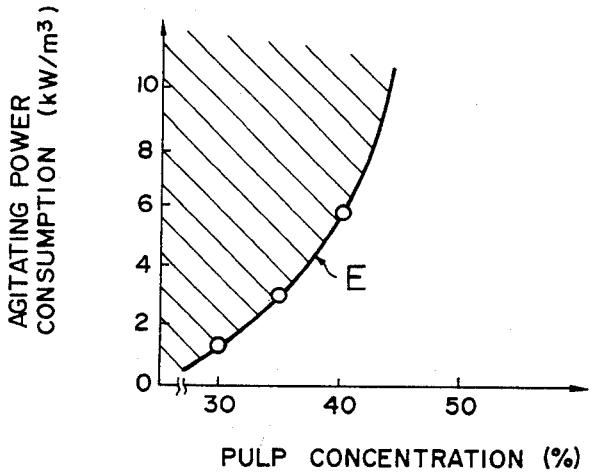
FIG. 4 is a diagram showing a uniform agitating area in the initial period of agglomeration process as the basis of the present invention.

As shown in FIG. 4, it has been found that the uniform mixing area is given by the hatched area at the left side of uniform agitation limit curve E in the initial period of agglomeration, that is, when the coal particles are small. As is obvious from FIG. 4, the pulp concentration of 40% by weight or less in terms of coal particles is suitable for the uniform mixing. Though there is the area for uniform mixing at a pulp concentration a little above 40% in terms of coal particles, the agitating power consumption becomes much higher at that pulp concentration. Thus, this is not preferable. The pulp concentration must be 40% by weight or less in terms of coal particles in the initial period of the agglomeration process.

Figure 5:
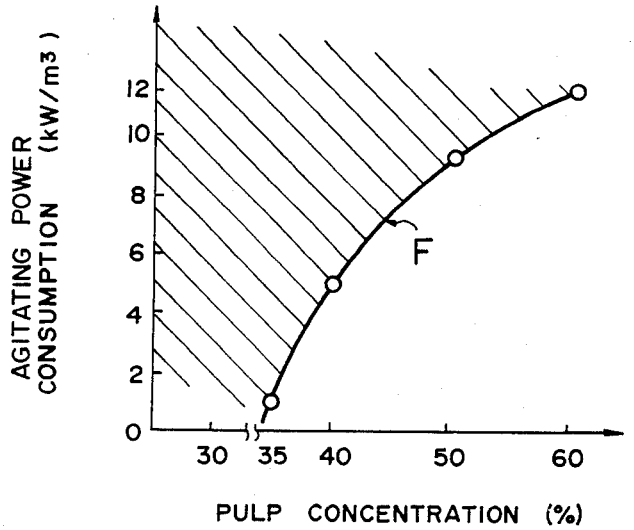
FIG. 5 is a diagram showing a uniform agitating area in the final period of agglomeration process as the basis of the present invention.

In selecting a final pulp concentration, quality of the product agglomerates should be taken into account. For evaluation of the quality, total moisture content of 12% or less shown in FIG. 1 is generally regarded as high quality, and it corresponds to the pulp concentration of 45% by weight in terms of coal particles in FIG. 1. Thus, it is preferable to select a final pulp concentration of 45% by weight or more in terms of coal particles. Such final pulp concentration of 45% by weight or more is used in the final concentration step, and the coal particles have been already agglomerated to about 2—about 3 mm through the preceeding coagulation and growth steps. Such agglomerated particles have less overall surface area than the original particles, and thus have a reduced force of coagulation on the whole, ensuring uniform agitating. Such area is given by the left side area of uniform agitating limit curve F in FIG. 5. That is, agglomeration can be carried out under a uniform agitating action even if a pulp concentration of 45% by weight or more in terms of coal particles is selected. However, if a very high pulp concentration is selected, the agitating power consumption will be considerably increased, as shown in FIG. 5, and thus it is preferable to select the pulp concentration at a lower level within the allowable range for the agglomerates with the high quality.

The present inventors have further found that a short path phenomenon appears when a pulp water containing coal particles not thoroughly treated in a preceeding agitating vessel is transferred continuously to a succeeding agitating vessel. For example, if the pulp water should take a short path from first agitating vessel 1 to third agitating vessel 3, agglomerates failing to meet the desired degree of agglomeration would be withdrawn as the product. To prevent such a short path phenomenon, it is quite effective to provide second agitating vessel 2 between first and third agitating vessels. That is, product agglomerates with the high quality can be obtained by providing at least three agitating vessels in series. It is needless to say that provision of more agitating vessels between the initial agitating vessel and the last one can assure production of agglomerates with an improved quality.

As described above, agglomeration of coal particles in pulp water can be efficiently carried out with less agitating power consumption by conducting the agglomeration in a plurality of zones, the zones being communicated one after another, and transferring the pulp water from one zone to another, while agitating the pulp water in each zone and increasing a pulp concentration of the pulp water from one zone to another.

What is claimed is:

1. A method for agglomerating coal particles in pulp water of coal particles by agitating the pulp water in the presence of a binder, which comprises conducting agglomeration in at least three zones, the zones being in communication one after another, charging the pulp water and the binder only into a first zone, agitating the charged pulp water and binder while maintaining a coal concentration in the pulp water of 40% by weight or less in terms of the coal particles, transferring the pulp water together with the binder agitated in the first zone, to successive zones, one after another, and agitating the pulp water in each successive zone while removing water from the pulp water in each successive zone after the first zone, thereby increasing the coal concentration in the pulp water in each successive zone.

2. The method according to claim 1, wherein the zones each constitute isolated agitating vessels, and the pulp water is transferred from one of the agitating vessels to another vessel through a passage that effects communication between the one vessel and the another vessel.

3. The method according to claim 2, wherein the agglomeration is carried out in at least three agitating vessels, and the pulp water is successively transferred through at least three agitating vessels.

4. The method according to claim 2, wherein water is drained from successive agitating vessels, thereby increasing the coal concentration.

5. A method for agglomerating coal particles in pulp water of coal particles wherein the pulp water is admixed with a binder by agitation, which comprises effecting agglomeration of the coal particles in a plurality of agitation zones including at least two successively arranged agitation zones by effecting agitation of the pulp water together with the binder in each zone, by transferring the pulp water together with the binder batch-wise from one zone to another zone and by removing supernatant water from each zone other than the initial zone into which the pulp water is introduced to increase the concentration of coal particles in the pulp water in each of the successive zones; the concentration of coal particles in the pulp water being 40% by weight or less in the initial zone.

6. The method of claim 5, wherein the concentrated pulp water is transferred to an agglomerate tank in which the agglomerated coal particles are separated from water.

* * * * *